US009389537B2

(12) United States Patent
Fujii

(10) Patent No.: US 9,389,537 B2
(45) Date of Patent: Jul. 12, 2016

(54) DEVELOPER HOLDING APPARATUS, IMAGE FORMING UNIT, AND IMAGE FORMING APPARATUS

(71) Applicant: Oki Data Corporation, Tokyo (JP)

(72) Inventor: Masashi Fujii, Tokyo (JP)

(73) Assignee: OKI DATA CORPORATION, Tokyo (JP)

( * ) Notice: Subject to any disclaimer, the term of this patent is extended or adjusted under 35 U.S.C. 154(b) by 0 days.

(21) Appl. No.: 13/946,213

(22) Filed: Jul. 19, 2013

(65) Prior Publication Data

US 2014/0029984 A1 Jan. 30, 2014

(30) Foreign Application Priority Data

Jul. 27, 2012 (JP) ..... 2012-167555

(51) Int. Cl.
*G03G 15/08* (2006.01)

(52) U.S. Cl.
CPC ..... *G03G 15/0865* (2013.01); *G03G 15/087* (2013.01); *G03G 15/0886* (2013.01); *G03G 2215/0819* (2013.01); *G03G 2215/0875* (2013.01)

(58) Field of Classification Search
CPC ..... G03G 15/0865; G03G 15/0867; G03G 15/087; G03G 15/0886
USPC ..... 399/258, 264, 263
See application file for complete search history.

(56) References Cited

U.S. PATENT DOCUMENTS

| | | | | |
|---|---|---|---|---|
| 6,496,671 | B2 * | 12/2002 | Nakajima | 399/120 |
| 2006/0239722 | A1 * | 10/2006 | Tanaka | G03G 15/0844 399/260 |
| 2007/0071503 | A1 * | 3/2007 | Sato | 399/258 |
| 2008/0193169 | A1 * | 8/2008 | Teramura | 399/262 |
| 2009/0185833 | A1 * | 7/2009 | Shimomura | 399/263 |
| 2009/0245883 | A1 * | 10/2009 | Koido et al. | 399/262 |
| 2010/0272474 | A1 * | 10/2010 | Sato | 399/254 |
| 2010/0278566 | A1 * | 11/2010 | Sato | 399/263 |
| 2010/0329746 | A1 * | 12/2010 | Sato | 399/258 |
| 2011/0103845 | A1 * | 5/2011 | Sato | 399/263 |
| 2011/0103846 | A1 * | 5/2011 | Ota | 399/263 |
| 2011/0129260 | A1 | 6/2011 | Fujii | |
| 2013/0149011 | A1 * | 6/2013 | Hayashida et al. | 399/263 |
| 2013/0170863 | A1 * | 7/2013 | Leemhuis et al. | 399/258 |
| 2013/0259533 | A1 * | 10/2013 | Hayashi et al. | 399/258 |

FOREIGN PATENT DOCUMENTS

| | | |
|---|---|---|
| EP | 1 041 453 A2 | 4/2000 |
| JP | 2007-25511 | 2/2007 |
| JP | 2007-86322 | 4/2007 |
| JP | 2011-13367 | 1/2011 |
| JP | 2011-118040 A | 6/2011 |

* cited by examiner

*Primary Examiner* — Billy Lactaoen
*Assistant Examiner* — Arlene Heredia Ocasio
(74) *Attorney, Agent, or Firm* — Rabin & Berdo, P.C.

(57) ABSTRACT

A developer holding apparatus includes a first chamber, a second chamber, a communication port, and a shutter. The first chamber holds a developer material therein. The second chamber is adjacent the first chamber, and holds the developer material therein. The first chamber communicates with the second chamber through the communication port. The shutter opens and closes the communication port.

20 Claims, 13 Drawing Sheets

DEVELOPER HOLDING APPARATUS, IMAGE FORMING UNIT, AND IMAGE FORMING APPARATUS

BACKGROUND OF THE INVENTION

1. Field of the Invention

The present invention relates to a developer holding apparatus that holds a developer material therein, an image forming unit that uses the developer holding apparatus, and an image forming apparatus that uses the developer holding apparatus.

2. Description of the Related Art

Developer holding apparatus that hold a developer material therein are well known. A developer holding apparatus is shipped from the factory with a developer material loaded therein, and is attached to an image forming unit or an image forming apparatus when in use. The developer holding apparatus supplies the developer material for forming an image.

Japanese Patent Laid-Open No. 2011-118040 discloses an image forming unit and an image forming apparatus that employ such a developer holding apparatus.

Even when a developer holding device is designed to have a large capacity, the device is required to have improved reliability.

SUMMARY OF THE INVENTION

An object of the invention is to provide a developer holding apparatus capable of efficiently supplying a developer material to an image forming unit or an image forming apparatus.

A developer holding apparatus includes a first chamber, a second chamber, a communication port, and a shutter. The first chamber holds a developer material therein. The second chamber is adjacent the first chamber, and holds the developer material therein. The first chamber communicates with the second chamber through the communication port. The shutter opens and closes the communication port.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given byway of illustration only, and thus are not limiting the present invention, and wherein.

DETAILED DESCRIPTION OF THE INVENTION

Embodiments of the invention will be described with reference to the accompanying drawings. The invention is not limited to these embodiments. A developer holding apparatus according to the present invention is used with an image forming unit or an image forming apparatus which may take a variety of forms. For simplicity, the invention will be described with respect to an image forming apparatus.

First Embodiment

{Configuration}

Figure 1:
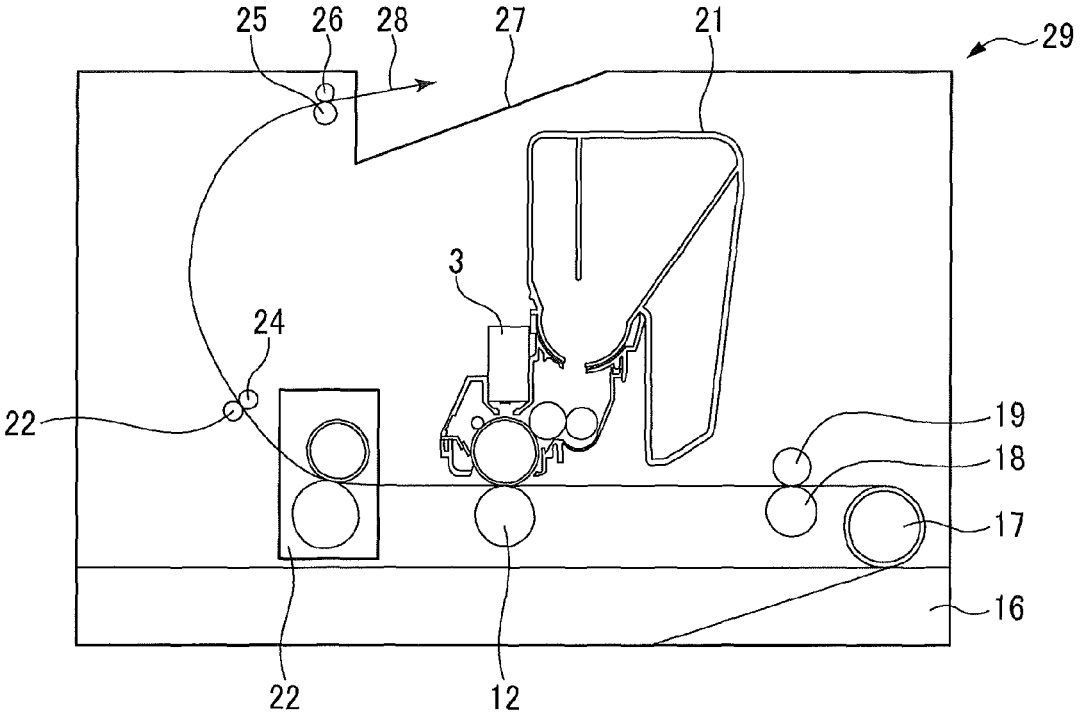
FIG. 1 illustrates the outline of an image forming apparatus according to the present invention.

FIG. 1 illustrates an outline of an image forming apparatus 29 according to a first embodiment of the present invention.

The image forming apparatus 29 includes a paper transporting path 28 that includes paper transporting rollers 17-19 and discharging rollers 23-26. A paper cassette 16 is disposed upstream of the paper transport path 28, and holds a stack of paper 13 as a recording medium. A stacker 27 is located downstream of the paper transporting path 28, and temporarily holds printed paper. The paper transporting path 28 also includes a transfer roller 12 that transfers a developer image onto the paper 13 and a fixing unit 22 that fuses the developer image into the paper 13. The transfer roller 12 is disposed immediately under an image forming unit 21.

Figure 2:
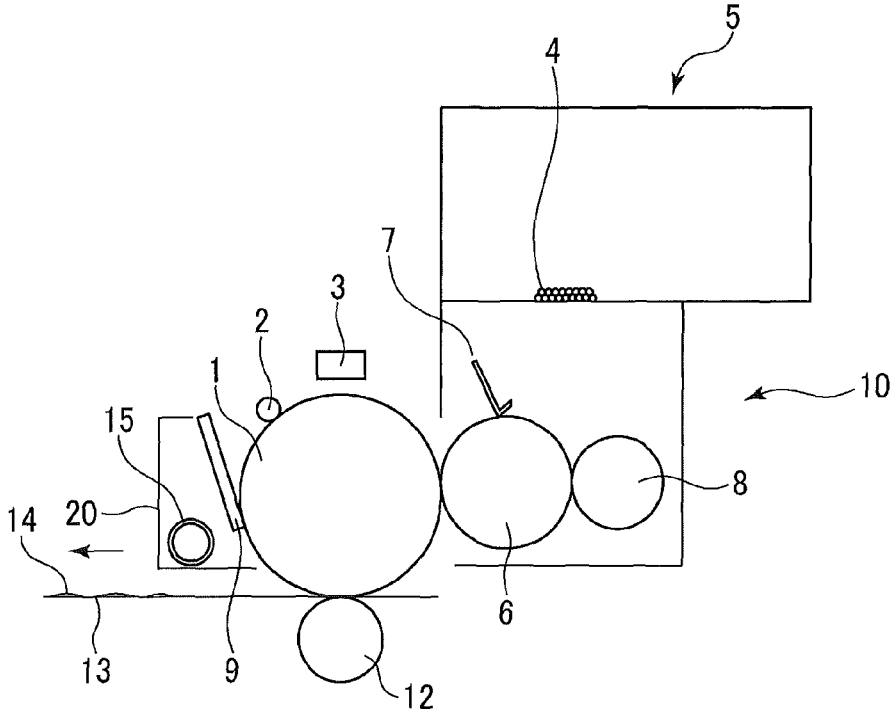
FIG. 2 illustrates the outline of an image forming unit.

FIG. 2 illustrates the outline of the image forming unit 21. The image forming unit 21 includes a developer holding apparatus 5, disposed at an upper portion of the image forming unit 21, and a print engine 10 disposed under the developer holding apparatus 5. The print engine 10 includes a photoconductive drum 1, a charging roller 2, a light emitting diode (LED) head 3, and a developing roller 6, a cleaning blade 9, a transport spiral 15, and a waste toner holder 20. The photoconductive drum 1 is rotatably supported so that the photoconductive drum 1 is driven in rotation by a drive source (not shown). The photoconductive drum 1 is capable of storing charges on its surface. The LED head 3 illuminates the charged surface of the photoconductive drum 1 in accordance with print data, thereby creating an electrostatic latent image on the photoconductive drum 1.

The charging roller 2 is in pressure contact with the surface of the photoconductive drum 1, and supplies a predetermined amount of charge to the surface of the photoconductive drum 1. The charging roller 2 rotates in the same direction as the photoconductive drum 1. The LED head 3 is disposed over the photoconductive drum 1, and illuminates the charged surface of the photoconductive drum 1 to dissipate the charge on the photoconductive drum 1, thereby forming an electrostatic latent image on the photoconductive drum 1. The developer holding apparatus 5 is located above the print engine 10, holds a developer material (e.g., toner) 4 therein, and supplies the developer material 4 to the print engine 10.

A developing roller 6 receives the developer material 4 from the developer holding apparatus 5, and supplies the developer material 4 to the electrostatic latent image formed on the photoconductive drum 1. A developer material supplying roller 8 supplies the developer material 4 to the developing roller 6. The developing blade 7 is in pressure contact with the developing roller 6, and forms a layer of the developer material 4 having a predetermined thickness on the developing roller 6.

The print engine 10 includes an opening 51 through which the developer material 4 is received from the developer holding apparatus 5. Once the developer holding apparatus 5 is attached to the print engine 10, the opening 51 (FIG. 3) is in alignment with a rectangular opening 40 (FIG. 3) formed in the developer holding apparatus 5.

The transfer roller 12 is disposed immediately under the photoconductive drum 1. The cleaning blade 9 is located immediately downstream of the transfer roller 12 with respect to rotation of the photoconductive drum 1. The cleaning blade 9 is in pressure contact with the surface of the photoconductive drum 1, and scrapes the residual developer material adhering to the surface of the photoconductive drum 1 after transfer of the developer image onto the paper, thereby collecting the waste developer material into the waste developer holder 20. The spiral 15 is located in the vicinity of the cleaning blade 9, and transports the scraped residual developer material into a side frame (not shown).

{Developer Holding Device}

Figure 3:
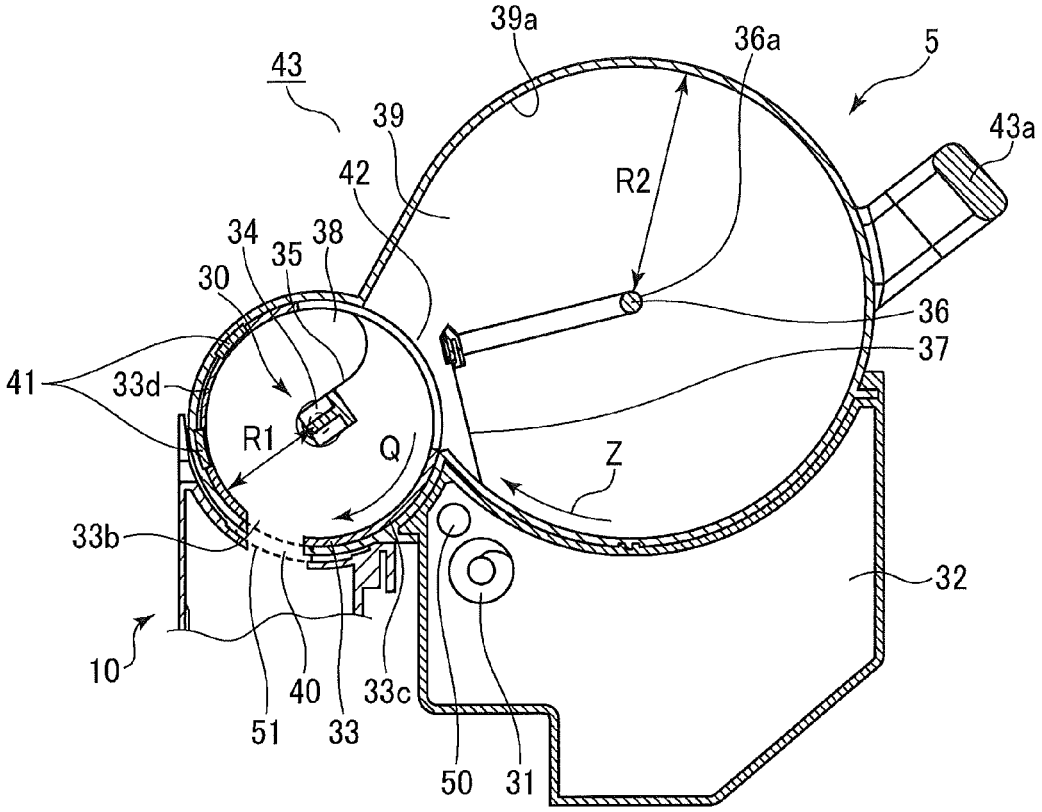
FIG. 3 is a cross-sectional view of the developer holding device according to the first embodiment.

FIG. 3 is a cross-sectional view of the developer holding apparatus 5 according to the first embodiment. The developer holding apparatus 5 will be described with reference to FIG. 3. The developer holding apparatus 5 is attached to the print engine 10, and supplies the developer material 4 into the print engine 10. The developer holding apparatus 5 includes a developer material chamber 43 that holds the developer material 4 therein, a waste developer material chamber 32 that holds the residual developer material that failed to be transferred onto the paper 13, and a handle 43*a* that is gripped by the user when the user attaches the developer holding apparatus 5 onto the print engine 10.

The developer material chamber 43 includes a sub chamber 38 in the shape of a small-diameter hollow cylinder that holds a small amount of the developer material 4 therein, a main chamber 39 in the shape of a large-diameter hollow cylinder that holds a large amount of the developer material 4 therein, and a communication port 42 through which the first and second chambers 38 and 39 communicate with each other. The sub chamber 38 has a shape such that a small-diameter hollow cylinder is cut in a plane parallel to the longitudinal axis of the small-diameter hollow cylinder. The main chamber 39 has a shape such that a large-diameter hollow cylinder is cut in a plane parallel to the longitudinal axis of the large-diameter hollow cylinder. The first and second chambers 38 and 39 are put together at their portions cut in the planes parallel to the corresponding longitudinal axes. The developer material 4 is directed from the main chamber 39 into the sub chamber 38 through the communication port 42, and then into the print engine 10 via the opening 33*b* formed in the shutter 33 (FIG. 4), the opening 40 formed in the sub chamber 38, and the opening 51 formed in the print engine 10.

Once the developer holding apparatus 5 is attached to the print engine 10, the developer material chamber 43 is oriented such that the main and sub chambers 39 and 38 are positioned substantially horizontally side by side and their bottoms lie substantially in a horizontal plane. In this manner, the developer holding apparatus 5 is maintained at a minimum height in the image forming apparatus 29.

The sub chamber 38 includes a shutter 33, a sub agitator 30, and the opening 40.

The shutter 33 is rotatably received in the sub chamber 38, and simultaneously opens and closes the opening 40 and the communication port 42. In other words, the shutter 33 rotates in the sub chamber 38 to open and close the opening 40. The shutter 33 also rotates in the sub chamber 38 to open and close the communication port 42 through which the sub and main chambers 38 and 39 communicate with each other. After the developer holding apparatus 5 has been attached to the print engine 10, the user operates a lever (not shown) to rotate the shutter 33 between an opening position and a closing position. The shutter 33 closes both the opening 40 and the communication port 42 simultaneously, so that the developer material 4 is prevented from leaking from the developer holding apparatus 5 when the developer holding apparatus 5 is subjected to impact due to, for example, dropping. A sealing member 41 and a sealing wall 33*d* cooperate with each other to close the opening 40 hermetically, thereby preventing the developer material 4 in the sub chamber 38 from leaking through the opening 40. A sealing wall 33*c* closes the communication port 42, thereby preventing the pressure by the developer material 4 in the main chamber 39 from being exerted on the developer material in the sub chamber 38. This configuration prevents the sealing effect at the opening 40 from deteriorating. In other words, the shutter 33 and the sub chamber 38 serves as a buffer mechanism between the main chamber 43 and the print engine 10.

Figure 4:
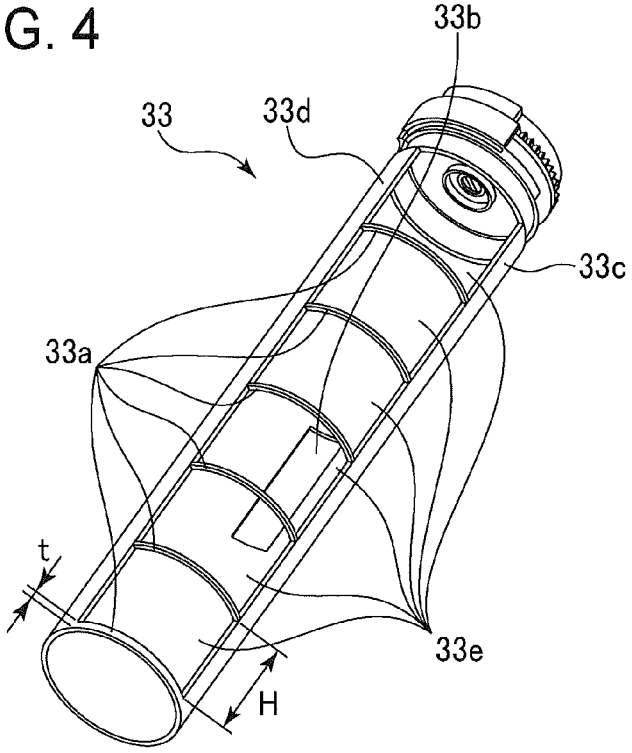
FIG. 4 is a perspective view of a shutter.
Figure 5:
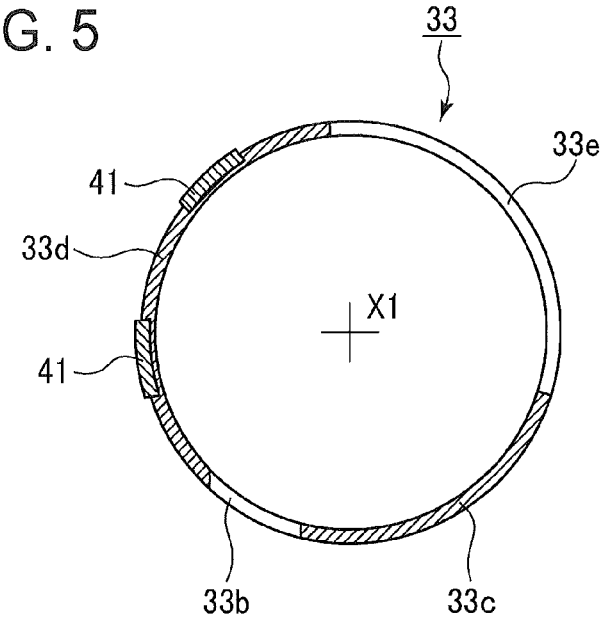
FIG. 5 is a cross-sectional view of the shutter taken along a line A-A in FIG. 4.

FIG. 4 is a perspective view of the shutter 33. FIG. 5 is a cross-sectional view of a pertinent portion of the shutter 33 shown in FIG. 4. The shutter 33 has a generally cylindrical shape, and has an outer diameter slightly smaller than the inner diameter of the sub chamber 38, so that the shutter 33 is rotatable in the sub chamber 38. The shutter 33 is formed of ABS resin.

The shutter 33 includes six arcuate or circumferential ribs 33*a*, opening 33*b*, a closing wall 33*c*, an opening 33*e*, a closing wall 33*d*, and the sealing member 41.

The circumferential ribs 33*a* are in the shape of an arc, which defines a part of the outer and inner diameters of the shutter 33. The circumferential ribs 33*a* are aligned at predetermined intervals H in a direction parallel to the rotational axis X1 (FIG. 5) of the shutter 33, thereby defining openings 33*e* between adjacent circumferential ribs 33*a*. The openings 33*e* have a dimension H in the longitudinal direction of the shutter 33. Each circumferential rib has a width of t. In the present embodiment, the dimension H is 30 mm and the width of t is 4 mm. The number of circumferential ribs 33*a*, which will be described later, may be selected according to the number of the sub films of a sub agitating film 35 of the sub agitator 30, for example, in the range of 1 to 5 or more than 7. When the shutter 33 opens the communication port 42, the circumferential ribs 33*a* prevent the sub agitating film 35 from entering the main chamber 39 and a main agitating film 37 from entering the sub chamber 38. In other words, the circumferential ribs 33*a* prevent the sub agitator 30 and a main agitator 49 (FIG. 8) from interfering with each other even when the communication port 42 is open.

The opening 33*b* (FIG. 4) has substantially the same size and shape as the opening 40 formed in the sub chamber 38, and is positioned at substantially longitudinally mid portion of the developer material holding apparatus 5. When the shutter 33 is rotated in an opening direction, the opening 33*b* becomes aligned with the opening 40 so that the sub chamber 38 communicates with the print engine 10 through the openings 33*b* and 40 and the developer material 4 is supplied into the print engine 10.

When the shutter 33 is rotated in a closing direction (opposite to a Q direction shown in FIG. 3), the closing wall 33*c* becomes aligned with the communication port 42, closing the communication port 42.

When the shutter 33 rotates in the closing direction, the closing wall 33*d* is brought into alignment with the opening 40, closing the opening 40.

The sealing member 41 provides a sealing environment for the opening 40. The sealing member 41 is located on the outer surface of the shutter 33, and is in the shape of a rectangular ring that surrounds the substantially rectangular opening 40. When the developer holding apparatus 5 has been attached to the print engine 10, the opening 40 faces the print engine 10 substantially downward.

The relative positions among the opening 40, the communication port 42, the opening 33*e*, and the closing wall 33*c* of the shutter 33 are related as follows: When the shutter 33 is rotated so that the opening 33*e* becomes aligned with the communication port 42 (opening position), the opening 33*e* becomes aligned with the communication port 42. When the shutter 33 is rotated to bring the closing wall 33*c* into alignment with the communication port 42 (closing position), the closing wall 33*d* becomes aligned with the opening 40.

{Sub Agitator}

The sub agitator 30 rotates in the sub chamber 38, while agitating the developer material 4 in the sub chamber 38. The sub agitator 30 includes a bar structure 34 and the sub agitating film 35. When the sub agitator 30 rotates, the sub agitating film 35 extending radially from the bar structure 34 scrapes the inner circumferential surface of the sub chamber 38. The bar structure 34 includes rotational shafts 34*a* that project from a body of the bar structure 34. The rotational shafts 34*a* extend oppositely substantially in the longitudinal direction of the bar structure 34, and are rotatably received in bearings (not shown) mounted at the longitudinal end walls of the sub chamber 38, so that the sub agitator 30 rotates in the sub chamber 38. The rotational axis X2 (FIG. 6) of the rotational shafts 34*a* is substantially in line with the centerline of the inner cylindrical space in the sub chamber 38.

Figure 6:
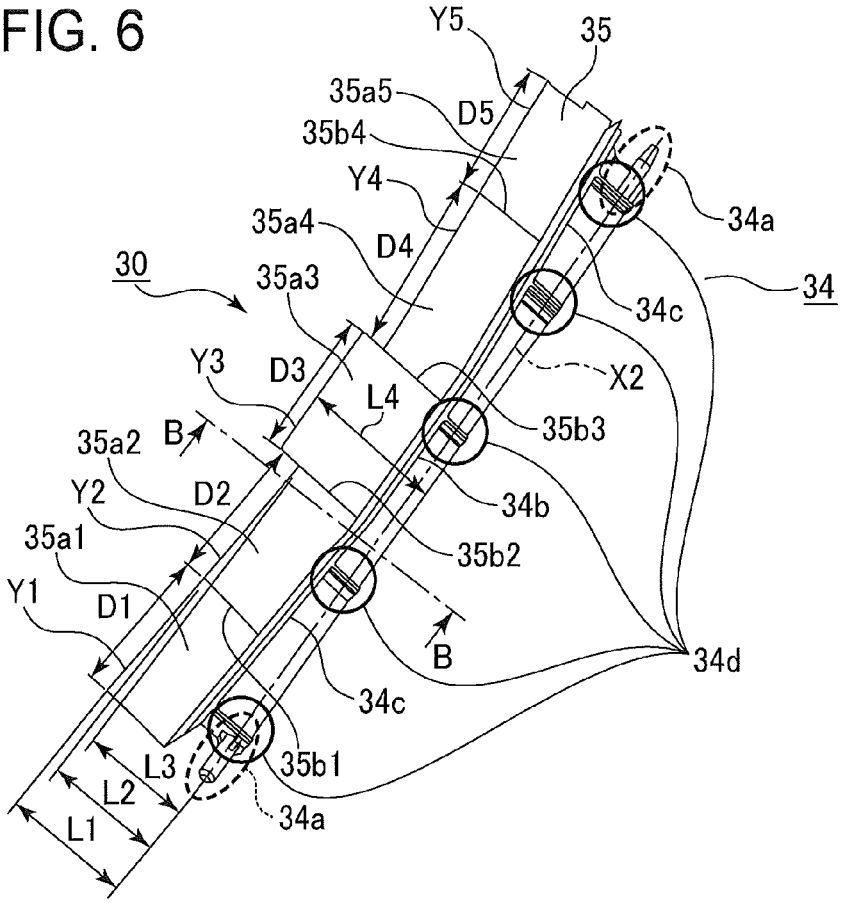
FIG. 6 is a perspective view illustrating the sub agitator.

FIG. 6 illustrates the sub agitator 30. The bar structure 34 includes a first mounting surface 34*b* and two inclined second mounting surfaces 34*c*. The bar structure 34 is in a single piece construction. The first mounting surface 34*b* is laterally centered between two longitudinal ends of the bar structure 34. The two second mounting surfaces 34*c* are positioned with the first mounting surface 34*b* located between the two second mounting surfaces. The first mounting surface 34*b* is contiguous with the second mounting surfaces 34*c*. The mounting surface 34*b* extends in a direction substantially parallel to the rotational axes of the rotational shafts 34*a*. Each of the second mounting surfaces 34*c* extends in such a direction as to become further away from the longitudinal axes of the rotational shafts 34*a* nearer the longitudinal end of the rotational shaft 34*a*. The bar structure 34 also includes five ribs 34*d* between the rotational shafts 34*a*

The sub agitating film 35 has cuts 35*b*1-35*b*4 to define five resilient thin sub films 35*a*1-35*a*5 that can resiliently deflect independently of one another, so that the sub films 35*a*1-35*a*5 resiliently scrape the inner surface of the shutter 33. The sub films 35*a*1-35*a*5 are mounted on the mounting surfaces 34*b* and 34*c* of the bar structure 34, and extend from the first mounting surface 34*b* and second mounting surface 34*c*. When the bar structure 34 rotates, the free ends Y1-Y5 of the sub films 35*a*1-35*a*5 scrape the inner surface of the circumferential ribs 33*a* but do not interfere with the main agitating film 37 in the main chamber 39.

The free end of the sub film 35*a*3 is further away from the longitudinal axes of the rotational shafts 34*a* than the free ends Y4 and Y2 of sub film 35*a*4 and 35*a*2. The free ends of the sub films 35*a*4, 35*a*5, 35*a*2, and 35*a*1 are further away from the rotational axis of the rotational shafts 34*a* nearer the longitudinal free ends of the bar structure 34.

The sub agitating film 35 extends from the bar structure 34 in a direction substantially perpendicular to the rotational axes of the shafts 34*a*, and is in resilient contact with the inner surface of the shutter 33, thereby ensuring that the developer material 4 in the sub chamber 38 is supplied into the print engine 10. In other words, the sub films 35*a*1 and 35*a*5 located near the longitudinal ends of the sub agitator 30 contact the inner surface of the sub chamber 38 under higher pressure than the sub films 35*a*2 and 35*a*4 located between the sub films 35*a*1 and 35*a*5, so that the developer material 4 adhering to the inner surface of the sub chamber 38 is collected toward a longitudinally middle portion of the sub chamber 38. The free end of the sub film 35*a*3 is further away from the rotational axes of the shafts 34*a* than the portion of the sub films 35*a*1 and 35*a*5 immediately adjacent to the thin sub film 35*a*3, and strongly scrapes the inner surface of the shutter 33, thereby guiding the developer material 4 toward the opening 40. In this manner, the developer material 4 may be discharged into the print engine 10 through the opening 40.

Specifically, the distance R1 (FIG. 3) between the rotational axis of the shafts 34*a* and the inner surface of the sub chamber 38 is 26 mm. The distance L1 between the free ends of the sub films 35*a*1 and 35*a*5 and the rotational axis of the rotational shafts 34*a* is 30 mm. Since the distances R1 and L1 are related such that R1<L1, the sub agitating film 35 is in resilient contact with the inner circumferential surface of the shutter 33.

Figure 7:
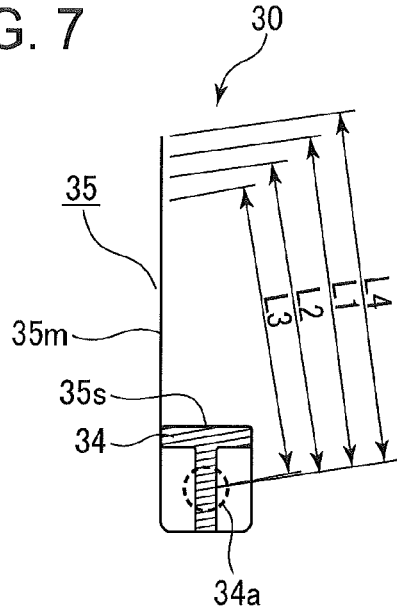
FIG. 7 is a side view of the sub agitator.

FIG. 7 is a side view of the sub agitator 30.

The sub agitating film 35 has a substantially L-shaped cross section with a long side 35*m* and a short side 35*s*. The short side 35*s* is fixed to the mounting surfaces 34*b* and 34*c* by, for example, thermal caulking.

The five sub films 35*a*1-35*a*5 have lengths D1, D2, D3, D4, and D5 (FIG. 6) in the longitudinal direction of the sub agitator, respectively.

The sub films 35*a*1, 35*a*2, and 35*a*3 have distances L1, L2, L3, and L4 from the rotational axis of the rotational shaft 34*a*, respectively. The L1 is the distance of the free end Y1 of the sub film 35*a*1 from the rotational axis of the rotational shaft 34*a*, the free end Y1 being at the longitudinal end of the sub agitating film 35. The L2 is the distance of the free end Y1 of the sub film 35*a*1, immediately adjacent the sub film 35*a*2, from the rotational axis of the rotational shaft 34*a*. The L3 is the distance of the free end Y2 of the sub film 35*a*2 from the rotational axis of the rotational shaft 34*a*, the free end Y2 being immediately adjacent the sub film 35*a*3. The L4 is the distance of the free end Y3 of the sub film 35*a*3 from the rotational axis of the rotational shaft 34*a*. The distances L1-L4 and R1 are related such that R1<L3<L1<L4, and allow the sub agitating film 35 to be in resilient contact with the inner circumferential surface of the shutter 33, thereby ensuring that the developer material 4 is efficiently supplied into the engine 10 through the opening 40.

The sub films 35*a*4 and 35*a*5 and the sub films 35*a*1 and 35*a*2 are symmetrical with respect to the sub film 35*a*3, and therefore the description of the distances of the thin sub films 35*a*4 and 35*a*5 from the rotational axes of the shafts 34*a* is omitted. Referring to FIG. 6, the dimensions D1-D5 and the distances L1-L4 are related such that D1, D2, and D3 are 40 mm, D4 is 50 mm, D5 is 36 mm, L1 is 30 mm, L2 is 28 mm, L3 is 26 mm, and L4 is 35 mm. The sub agitating film 35 is formed of polyethylene terephthalate (PET), and has a thickness of 0.1 mm. However, the sub agitating film 35 may be formed of a variety of materials and have a variety of dimensions. In addition, the sub agitating film 35 may have more than five sub films. The bar structure 34 may be formed of other material than ABS resin.

{Main Agitator}

Figure 8:
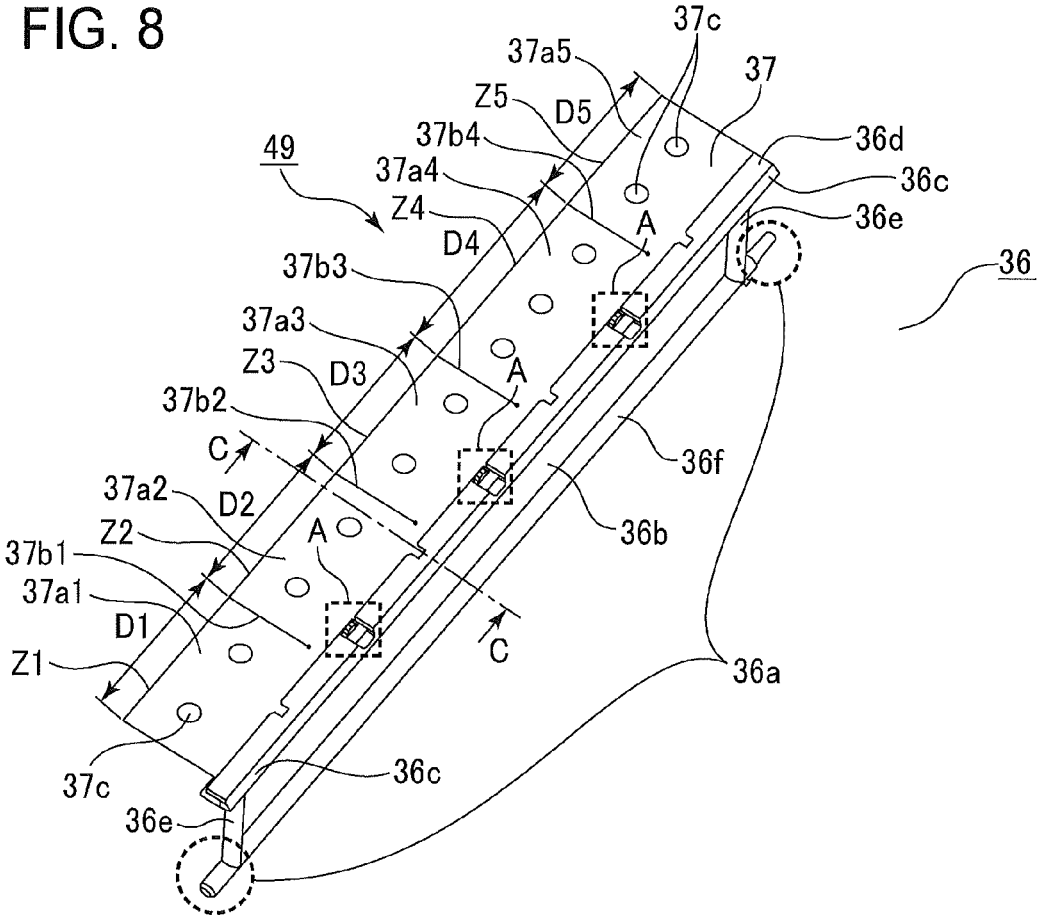
FIG. 8 is a perspective view of the main agitator.
Figure 9:
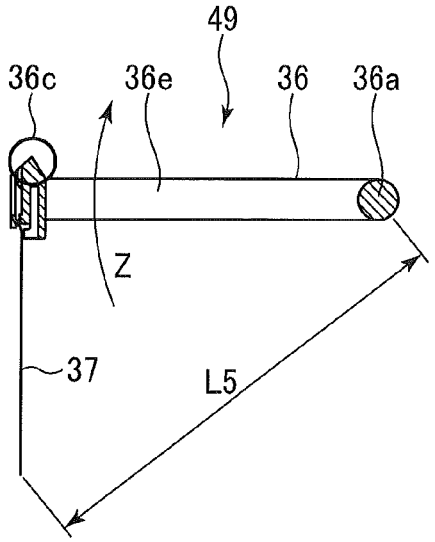
FIG. 9 is a cross-sectional view taken along a line C-C in FIG. 8.

FIG. 8 is a perspective view of the main agitator 49 and FIG. 9 is a cross-sectional view taken along a line C-C in FIG. 8. The main agitator 49 includes a bar structure 36 formed in a one piece construction and a resilient thin film 37 mounted thereto. The bar structure 36 includes a mounting bar 36*d*, rotational shafts 36*a*, and supporting bars 36*e*. The rotational shafts 36*a* oppositely extend in a longitudinal direction of the bar structure 36. The supporting bars 36*e* extend in a radial direction from the mounting bar 36*d*. The resilient thin film 37 is mounted securely to the mounting bar 36*d* at a portion depicted at "A," and extends in a direction perpendicular to the supporting bars 36*e*. The rotational shafts 36*a* are in line with a centerline of the cylindrical space of the main chamber 39. The shafts 36*a* are rotatably received in bearings at longitudinal ends of the main chamber 39, and the main agitator 49 rotates in a direction shown by arrow Z (FIG. 3).

The mounting bar 36*d* spans across the supporting bars 36*e*, thereby defining a space 36*b* bounded by the supporting bars 36*e*, bar 36*f*, and the mounting bar 36*d*. The resilient thin film 37 is fixed at its one end to the mounting bar 36*d*, and extends to the inner circumferential surface of the main chamber 39. The mounting bar 36*d* includes a tapered end 36*c* formed on a leading end thereof, tapered with respect to rotation of the main agitator 49, the tapered end being formed along the full length of the mounting bar 36*d*. When the main chamber 39 holds a large amount of the developer material 4 therein, the resilient thin film 37 may be unable to efficiently agitate the developer material 4 but the tapered end 36*c* of the mounting bar 36*d* is able to push its way through the pile of developer material while allowing the developer material 4 escaping through the space 36*b*. In this manner, the tapered end 36*c* prevents overloading of the resilient thin film 37.

When the main agitator 49 rotates in the Z direction, the resilient thin film 37 rotates so that the portion of the resilient thin film 37 fixed to the mounting bar 36*d* is a leading end and the free end of the resilient thin film 37 is a trailing end with respect to the direction of rotation of the main agitator 49. In other words, the resilient thin film 37 trails upstream of the direction of rotation of the main agitator 49. The free end resiliently drags the developer material 4 on the inner circumferential surface of the main chamber 39, thereby collecting the developer material 4. The resilient thin film includes five sub films 37*a*1-37*a*5 configured to resiliently deform independently of one another. Just as in the resilient thin film 35 of the sub agitator 30, when the main agitator 49 rotates, the free ends Z1-Z5 of the sub films 37*a*1-37*a*5 scrape the outer circumferential surface of the circumferential ribs 33*a* but do not interfere with the sub films 35*a*1-35*a*5 in the sub chamber 38.

This configuration minimizes the load exerted on the resilient thin film 37 during the rotation of the main agitator 49. The distance L5 between the rotational axis of the shafts 36*a* and the free end of the resilient thin film 37 is 56 mm. Selecting the distances R2 and L5 such that R2<L5 causes the free ends Z1-Z5 of the resilient thin film 37 to resiliently contact the inner circumferential surface of the main chamber 39.

The waste developer material chamber 32 may be separated from the developer material holding chamber 43, and includes a developer receiving opening 50 and a spiral 31. The developer receiving opening 50 receives the waste developer material, which failed to be transferred onto the paper 13. The waste developer material is directed through the developer receiving opening 50 into the back end of the waste developer material chamber 32 for efficient utilization of storing space.

The main agitating film 37 has cuts 37*b*1-37*b*4 to define five resilient thin sub films 37*a*1-37*a*5 that can resiliently deflect independently of one another, so that the sub films 35*a*1-35*a*5 resiliently scrape the inner circumferential surface of the shutter 33. Each of the sub films 37*a*1-37*a*5 have holes 37*c* formed therein which alleviate the load on the sub films 37*a*1-37*a*5 exerted by the developer material 4. The sub films 37*a*1-37*a*5 have lengths D1, D2, D3, D4, and D5 extending in a direction parallel to the rotational axis of the shafts 36*a*, respectively, and a distance L5 (FIG. 9) between the free ends Z1-Z5 of sub films 37*a*1-37*a*5 and the rotational axis of the shafts 36*a*. The resilient thin film 37 has a thickness of 0.1 mm, and is formed of polyethylene terephthalate (PET). The bar structure 36 is formed of ABS resin. However, the resilient thin film 37 and the bar structure 36 may be formed of a variety of materials.

Figure 10:
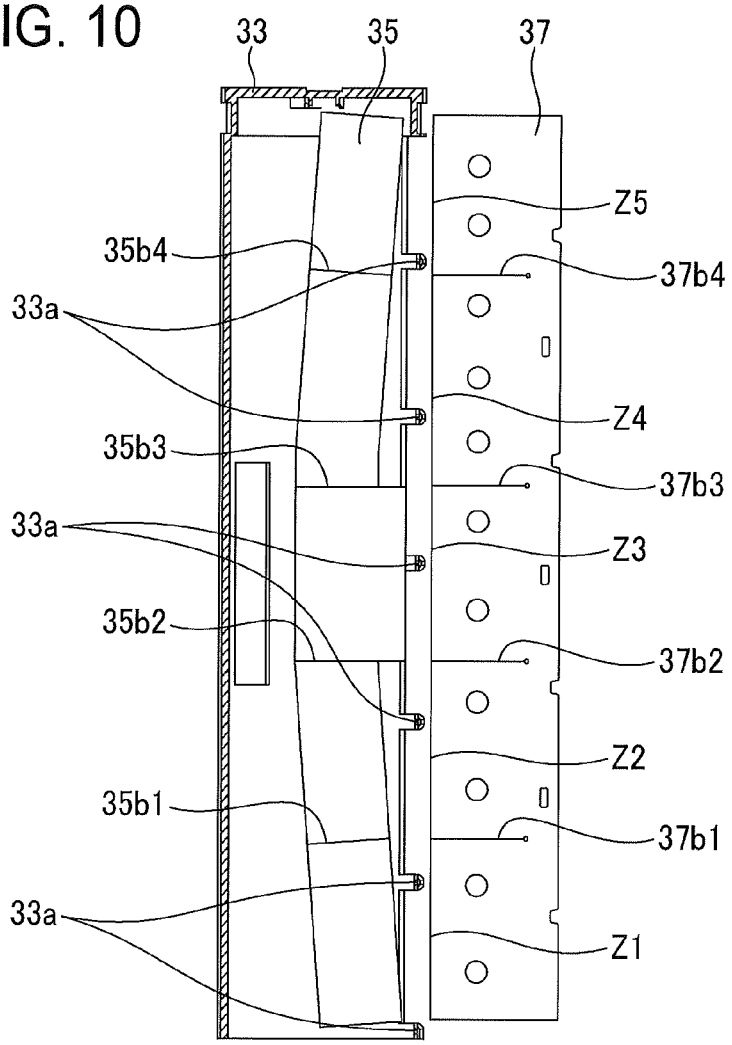
FIG. 10 illustrates the positional relation among arcuate ribs and the boundaries between adjacent sub films.

FIG. 10 illustrates the positional relation among the circumferential ribs 33*a*, and the cuts 35*b*1-35*b*4 between the adjacent sub films 35*a*1-35*a*5 and the cuts 37*b*1-37*b*4 between the adjacent sub films 37*a*1-37*a*5. It is to be noted that the circumferential ribs 33*a* do not face the cuts 35*b*1-35*b*4 and 37*b*1-37*b*4, or the cuts 35*b*1-35*b*4 and 37*b*1-37*b*4 do not face the circumferential rib 33*a* so that the circumferential ribs 33*a* do not enter the cuts 35*b*1-35*b*4. Therefore, the circumferential ribs 33*a* prevent the sub films 37*a*1-37*a*5 from entering the sub chamber 38 and the sub films 35*a*1-35*a*5 from entering the main chamber 39.

The bar structure 36 formed of ABS resin is more rigid than the main agitating film 37 formed of PET. The supporting bars 36*e* extend from the bar 36*f* in directions perpendicular to the direction in which the rotational shafts 36*a* and the bar 36*f* extend. The main agitating film 37 is supported on a side of the supporting bars 36*e* opposite the bar 36*f*, and lies in a plane that forms an angle in the range of 60-150 degrees with the supporting bars 36*e*, preferably perpendicular to the bar 36*f*. In other words, the main agitating film 37 is away from the bar 36*f* and rotational shafts 36*a*, and lies in a plane parallel to the rotational shaft 36*a* and the bar 36*f*.

{Operation of Image Forming Apparatus}

Rollers 17-19 cooperate to receive the paper 13 from the paper cassette 16 and feed the paper 13 into the transport path 28. The transfer roller 12 transfers the developer image onto the paper 13. The fixing unit 22 fixes the developer image on the paper 13. After fixing, the paper 13 is discharged onto the stacker 27.

The image forming unit 21 will be described.

The charging roller 2 uniformly charges the surface of the photoconductive drum 1. The LED head 3 illuminates the charged surface of the photoconductive drum 1 to form an electrostatic latent image on the surface. The developer holding apparatus 5 is on the print engine 10, and supplies the developer material 4 into the print engine 10. The supplying roller 8 supplies the developer material 4 to the developing roller 6. The developing blade 7 forms a thin layer of the developer material 4. The thin layer is then brought into contact with the electrostatic latent image, thereby developing the electrostatic latent image into a developer image 14. The developer image is then transferred by the transfer roller 12 onto the paper 13. The residual developer, which failed to be transferred onto the paper 13, is collected by the cleaning blade 9, and is transported by the spiral 15 to the side frame (not shown) of the print engine 10. The residual developer is further transported from the side frame to the developer receiving opening 50 through which the residual developer is stored into the waste developer material chamber 32. The residual developer in the waste developer material chamber 32 is spread by the spiral 31 so that the residual developer is efficiently stored in the waste developer material chamber 32.

{Developer Material Holding Device}

Figure 11:
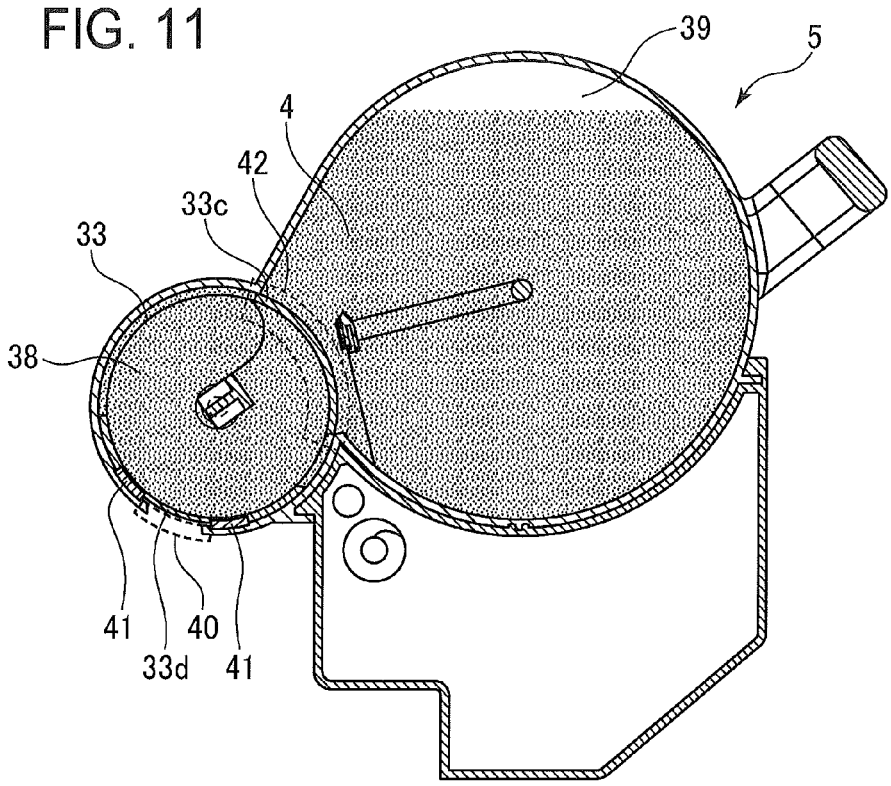
FIG. 11 illustrates the developer holding device before it is unsealed.

The developer holding apparatus 5 will be described with reference to FIG. 11. FIG. 11 illustrates the developer holding apparatus 5 before it is unsealed, i.e., immediately after shipment from the factory. When the developer holding apparatus 5 remains unsealed, the opening 40 remains closed by the sealing wall 33*d* and sealing member 41 so that the developer material 4 will not leak from the developer holding apparatus 5. The communication port 42 is closed by the closing walls 33*c*. Therefore, even if unwanted physical forces are exerted on the developer holding apparatus 5 due to vibration during transportation and inadvertent dropping, the pressure of the developer material 4 in the main chamber 39 is not transmitted to the developer material in the sub chamber 38. In other words, the shutter 33 serves as a buffer mechanism, preventing the pressure of the developer material 4 in the main chamber 39 from being transmitted to the developer material in the sub chamber 38. This configuration prevents the developer material in the sub chamber 38 from leaking from the sub chamber 38 through the opening 40.

It is to be noted that the sub chamber 38 holds a smaller amount of developer material than the main chamber 39. Therefore, when the unwanted physical forces are exerted on the developer holding apparatus 5 due to vibration during transportation or inadvertent dropping, only the pressure of the developer material in the sub chamber 38 is exerted on the closing wall 33*d* that closes the opening 40. Therefore, the pressure exerted on the closing wall 33*d* can be minimized.

Figure 12:
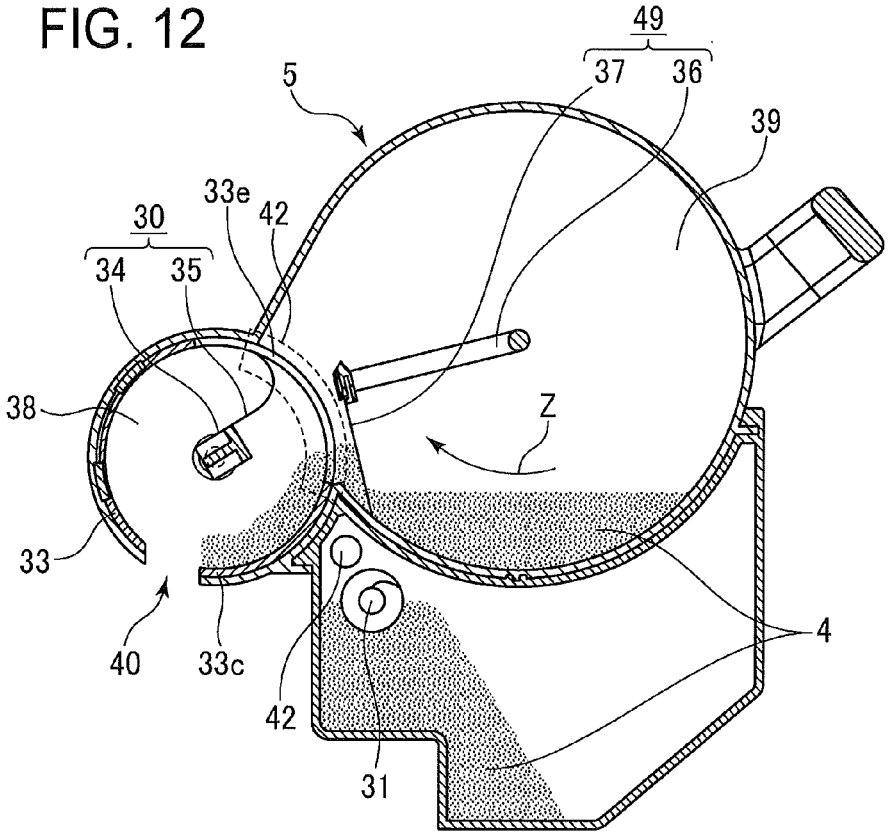
FIGS. 12-14 illustrate the position of the main agitator as the main agitator rotates in the Z direction.
Figure 13:
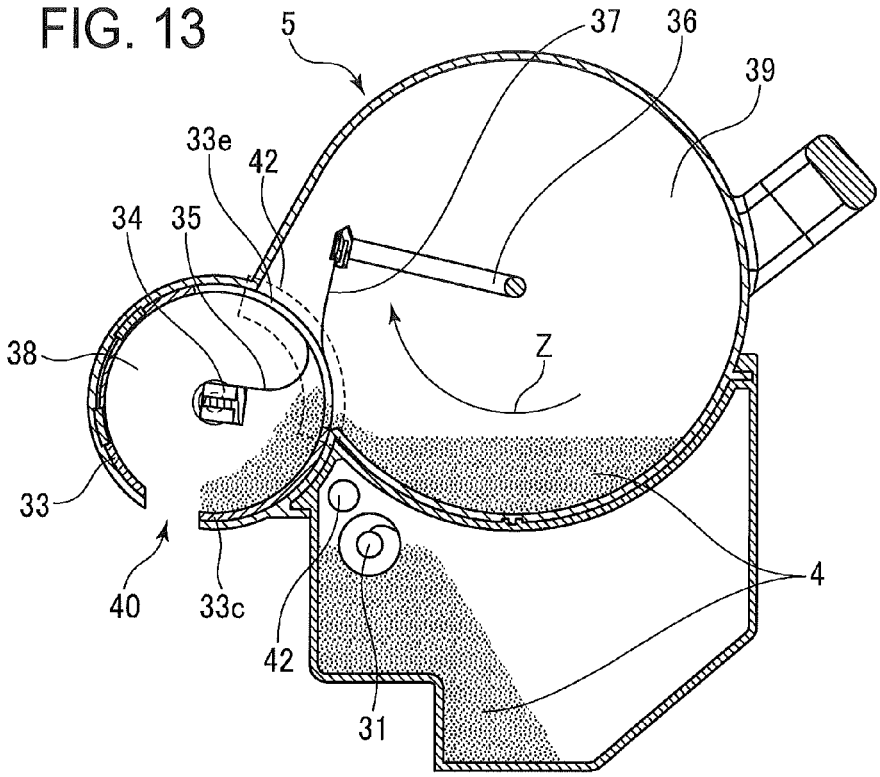
Figure 14:
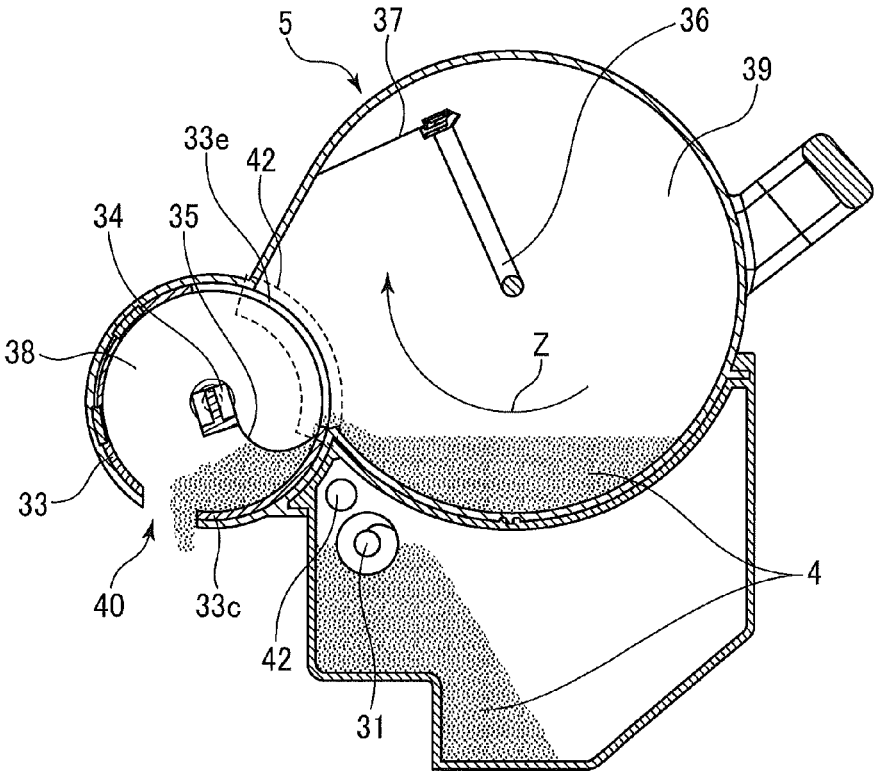

FIGS. 12-14 illustrate the position of the main agitator 49 as the main agitator 49 rotates in the Z direction. The operation of the developer holding apparatus 5 will be described with reference to FIGS. 12-14. Assume that when the main agitator 49 is in FIG. 12 position, the user operates a lever (not shown) to open the shutter 33. The opening 40 is opened and the developer material 4 may be supplied from the developer holding apparatus 5 into the print engine 10. When the opening 40 is opened, the openings 33*e* are also in alignment with the communication port 42 so that the developer material 4 may be supplied from the main chamber 39 into the sub chamber 38.

Referring to FIG. 13, the main agitator 49 rotates so that the sub films 37*a*1-37*a*5 transport the developer material 4 from the main chamber 39 into the sub chamber 38. The sub agitator 30 also rotates so that the sub films 35*a*1-35*a*5 transport the developer material 4 from the sub chamber 38 into the print engine 10. The circumferential ribs 33*a* prevent the sub films 37*a*1-37*a*5 from entering the sub chamber 38 and the sub films 35*a*1-35*a*5 from entering the main chamber 39, the sub films 37*a*1-37*a*5 rubbing the outer arcuate surface of the circumferential ribs 33*a* and the sub films 35*a*1-35*a*5 rubbing the inner arcuate surface of the circumferential ribs 33*a*.

{Effects}

The sub films 35*a*1-35*a*5 of the sub agitator 30 and the sub films 37*a*1-37*a*5 of the main agitator 49 rotate simultaneously to efficiently transport the developer material 4 into the print engine 10.

Until the developer holding apparatus 5 is attached to the print engine 10, the closing wall 33*c* of the shutter 33 prevents the pressure of the developer material 4 in the main chamber 39 from being exerted on the developer material 4 in the sub chamber 38, thereby minimizing the chance of the developer material 4 leaking from the sub chamber 38 through the opening 40. This configuration increases the reliability of the developer holding apparatus 5.

The circumferential ribs 33*a* serve to isolate the sub films 37*a*1-7*a*5 from the sub films 35*a*1-35*a*5, and prevent the sub films 37*a*1-7*a*5 and the sub films 35*a*1-35*a*5 from interfering with each other. This prevents abnormal sounds or the increase in load on the sub films 37*a*1-7*a*5 and 35*a*1-35*a*5 which would otherwise be caused by the sub agitating film 35 and main agitating film 45 interfering with each other.

One way of preventing the sub films 35*a*1-35*a*5 from interfering with the sub films 37*a*1-37*a*5 is to cause the sub agitator 30 and the main agitator 49 to rotate in such away that the sub films 35*a*1-35*a*5 and 37*a*1-37*a*5 do not meet at the communication port 42 when they are rotating. However, such a configuration may lead to complicated design and assembly of the developer holding apparatus 5. Employing the circumferential ribs 33*a* simplifies the structure of the developer holding apparatus 5 and eliminates the complicated configuration of the sub films 35*a*1-35*a*5 and 37*a*1-37*a*5 such that they do not meet at the communication portion 42 when they are rotating.

If the sub and main agitators 30 and 49 are to be designed such that the sub films 35*a*1-35*a*5 and 37*a*1-37*a*5 do not meet at the communication port 42 when they are rotating, the sub films 37*a*1-37*a*5 should be highly resilient so that the sub films 37*a*1-37*a*5 repel the developer material 4 sufficiently and restore their original shape. However, when the sub films 37*a*1-37*a*5 repel the developer material 4, they may make abnormal sounds.

Second Embodiment

Figure 15:
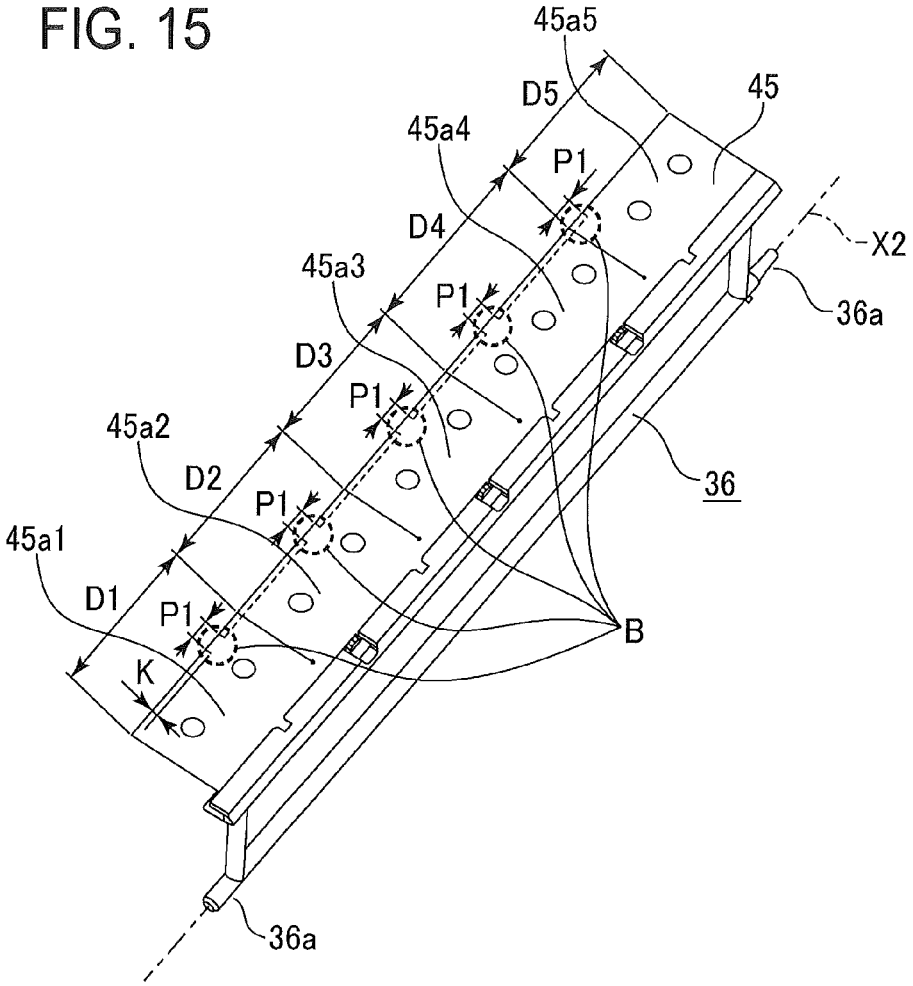
FIG. 15 is a perspective view of a main agitator according to a second embodiment.

FIG. 15 is a perspective view of a main agitator 49 according to a second embodiment.

In the second embodiment, the dimensions D1-D5 are related such that D1, D2, and D3 are 40 mm, D4 is 50 mm, D5 is 36 mm.

The sub agitating film 35 is formed of polyethylene terephthalate (PET), and has a thickness of 0.1 mm. However, the sub agitating film 35 may be formed of a variety of materials and have a variety of dimensions. In addition, the sub agitating film 35 may have more than five sub films. The bar structure 34 may be formed of other material than ABS resin.

Figure 16:
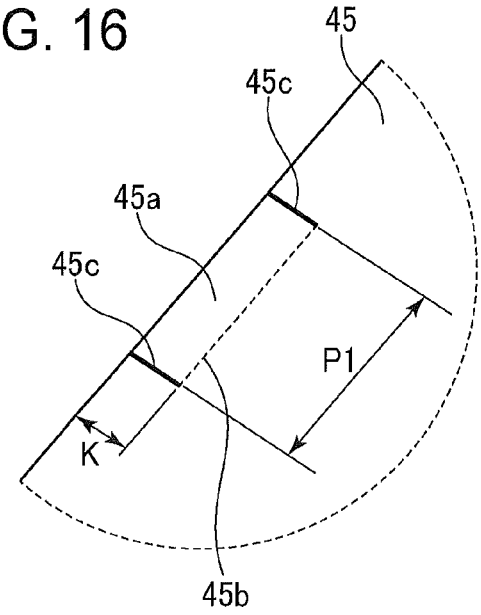
FIG. 16 is an expanded view of a pertinent portion of a main agitating film.

FIG. 16 is an expanded view of a pertinent portion of the main agitating film 45. The bar structure 36 and main agitating film 45 according to the second embodiment will be described with reference to FIGS. 15 and 16. Elements similar to those of the first embodiment have been given the same reference numerals as the first embodiment, and their description is omitted.

The main agitating film 45 has substantially the same shape as the main agitating film 37 except that each of sub films 45*a*1-45*a*5 of the main agitating film 45 has a corresponding pair of cuts or slits 45*c* as shown in FIG. 16 that define a deformable strip 45*a* therebetween. The cuts 45*c* have a length k of 2 mm, and are spaced apart by a distance P1 of 6 mm.

Figure 17:
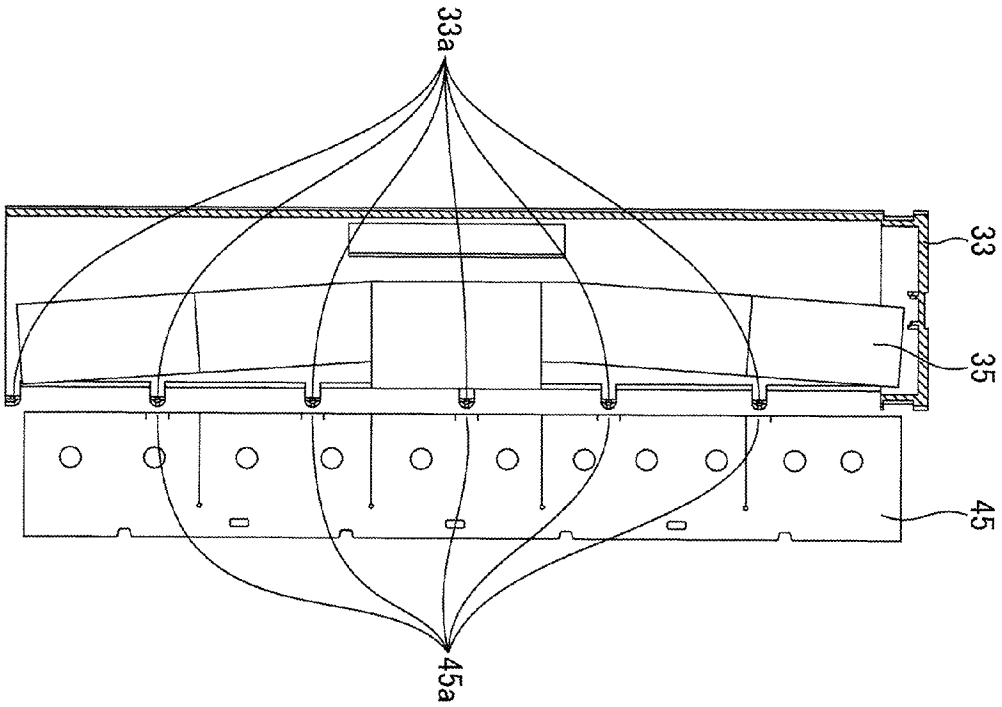
FIG. 17 illustrates the positional relation between the arcuate ribs of the shutter 33 and the cuts of the main agitating film.

FIG. 17 illustrates the positional relation between the circumferential ribs 33*a* of the shutter 33 and the cuts 45*c* of the main agitating film 45. As is clear from FIG. 17, each deformable strip 45*a* faces a corresponding one of the circumferential ribs 33*a*.

When the main agitator 49 rotates, the main agitating film 45 rotates so that the deformable strip 45*a* between a pair of cuts 45*c* is brought into pressure contact with a corresponding one of the circumferential ribs 33*a*. Thus, the free ends of the main agitating film 45 except for the deformable strip 45*a* extend toward the sub chamber 38 but not further than the inner surfaces of the circumferential ribs 33*a* (FIG. 19), so that the sub agitating film 35 and main agitating film 45 do not interfere with each other.

{Operation}

The operation of the developer holding apparatus 5 will be described. Just as in the first embodiment, the developer holding apparatus 5 shipped from the factory holds a large amount of the developer material 4 as shown in FIG. 11.

Figure 18:
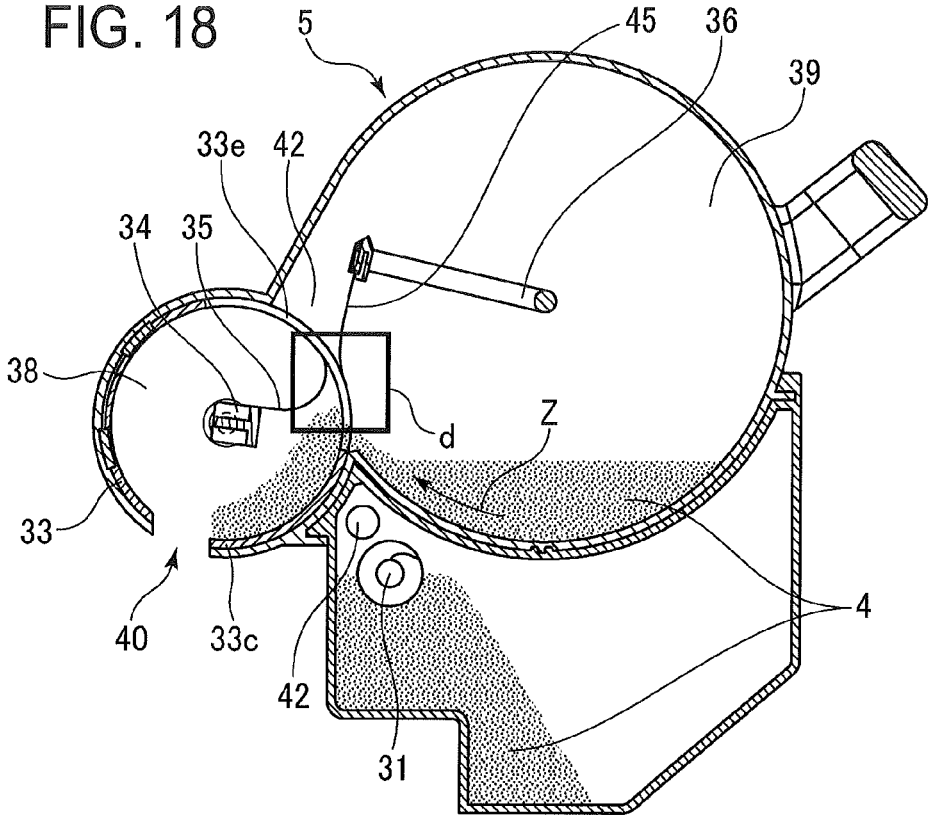
FIG. 18 illustrates the operation of a developer holding device according to the second embodiment.

FIG. 18 illustrates the operation of the developer holding apparatus 5 according to the second embodiment.

Figure 19:
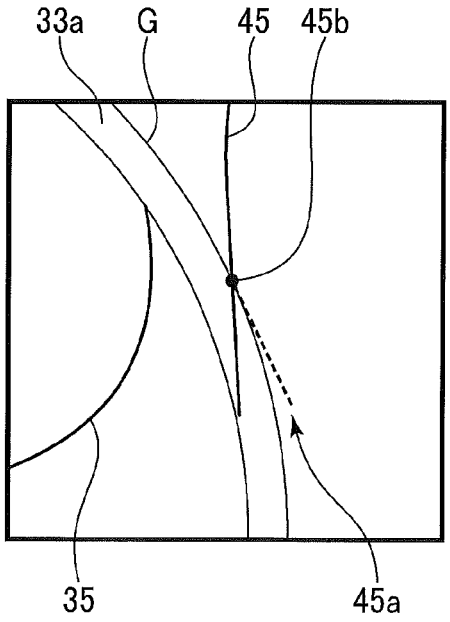
FIG. 19 is an expanded view of a portion depicted at "d" in FIG. 18.

FIG. 19 is an expanded view of a portion depicted at "d" in FIG. 18. The pertinent portion of the operation of the developer holding apparatus 5 will be described with reference to FIGS. 18 and 19. Referring to FIG. 18, when the main agitator 49 rotates, the developer material 4 is conveyed through the opening 33*e* of the shutter 33 from the main chamber 39 into the sub chamber 38. The circumferential ribs 33*a* at the opening 33*e* in the shutter 33 prevent the sub agitating film 35 from entering the main chamber 39. Referring to FIG. 19, the deformable strip 45*a* of the main agitating film 45 abuts the corresponding one of the circumferential ribs 33*a*, so that the deformable strip 45*a* deflects away from the circumferential rib 33*a*, and a base portion 45*b* of the deformable strip 45*a* between the cuts 45*c* abuts the outer arcuate surface G of the circumferential ribs 33*a*.

It is to be noted that the edge portions of the main agitating film 45 except the deformable strips 45*a* extend into the openings 33*e* further than the outer arcuate surface of the circumferential ribs 33*a* and serves to push the developer material 4 in the sub chamber 38 toward the opening 40. This increases the ability of the main agitating film 45 to deliver the developer material 4 into the sub chamber 38.

The sub and main agitators 30 and 49 rotate further from a position as shown FIG. 13, reaching a position as shown in FIG. 14 where the developer material 4 is pushed by the sub agitating film 35 toward the opening 40.

{Effects}

As described above, the second embodiment provides the following effects in addition to those of the first embodiment. When the main agitating film 45 rotates and abuts the outer surface of the circumferential ribs 33*a*, the free end portions of the main agitating film 45 except for the deformable strips 45*a* extend into the openings 33*e* but not further than the inner circumferential surface of the circumferential ribs 33*a*. This configuration is effective in minimizing the chance of the developer material 4 being left unused in the main chamber 39.

The free end portions except for the deformable strips 45*a* extend into the openings 33 but do not interfere with the sub agitating film 35, thereby eliminating abnormal sounds or the increase in load on the sub films 37*a*1-7*a*5 and 35*a*1-35*a*5, which would otherwise be caused by the sub agitating film 35 and main agitating film 45 interfering with each other.

{Modifications}

Figure 20:
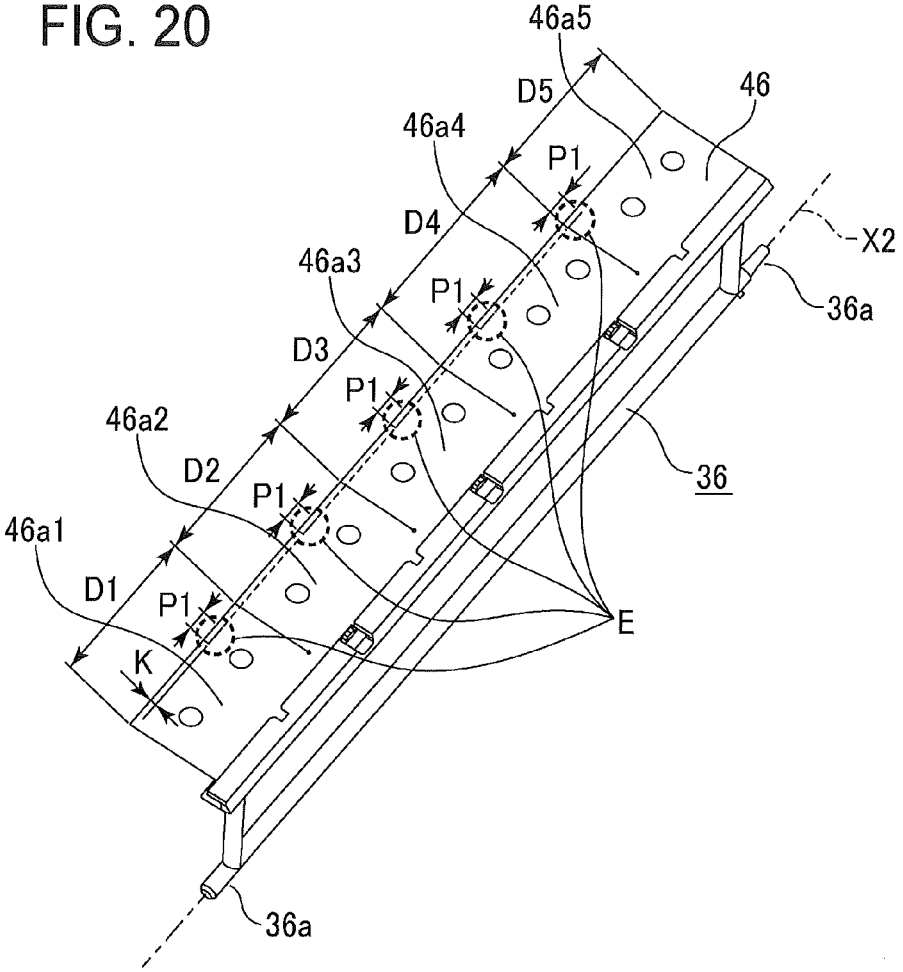
FIGS. 20 and 21 illustrate a first modification to the second embodiment.
Figure 21:
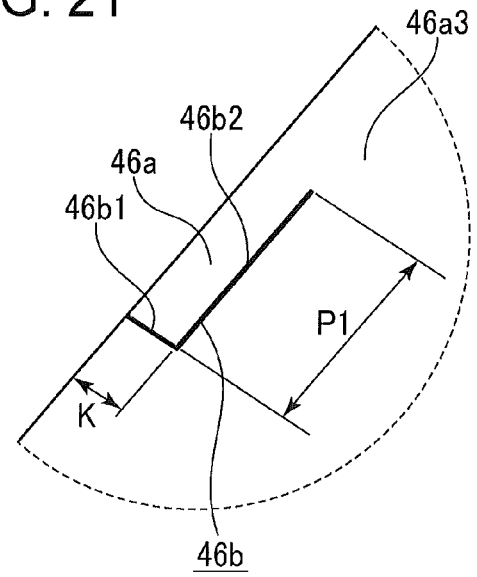

FIGS. 20 and 21 illustrate a first modification to the second embodiment. A main agitating film 46 according to the first modification has substantially the same shape as the main agitating film 45 according to the second embodiment. The main agitating film 46 has L-shaped cuts 46*b* that define a deformable strip 46*a*. The L-shaped cuts 46*b* include a short side 46*b*1 and a long side 46*b*2. The short side 46*b*1 extends in a direction substantially perpendicular to a direction in which rotational shafts 36*a* extend. The long side 46*b*2 extends in a direction substantially parallel to the direction in which the rotational shafts 36*a* extend. The short side 46*b*1 has a length k, e.g., 2 mm. The long side 46*b*2 has a length P, e.g. 6 mm.

The deformable strip 46*a* abuts the outer arcuate surface of the circumferential rib 33*a*, and provides similar effects to the main agitating film 45 of those of the second embodiment.

Figure 22:
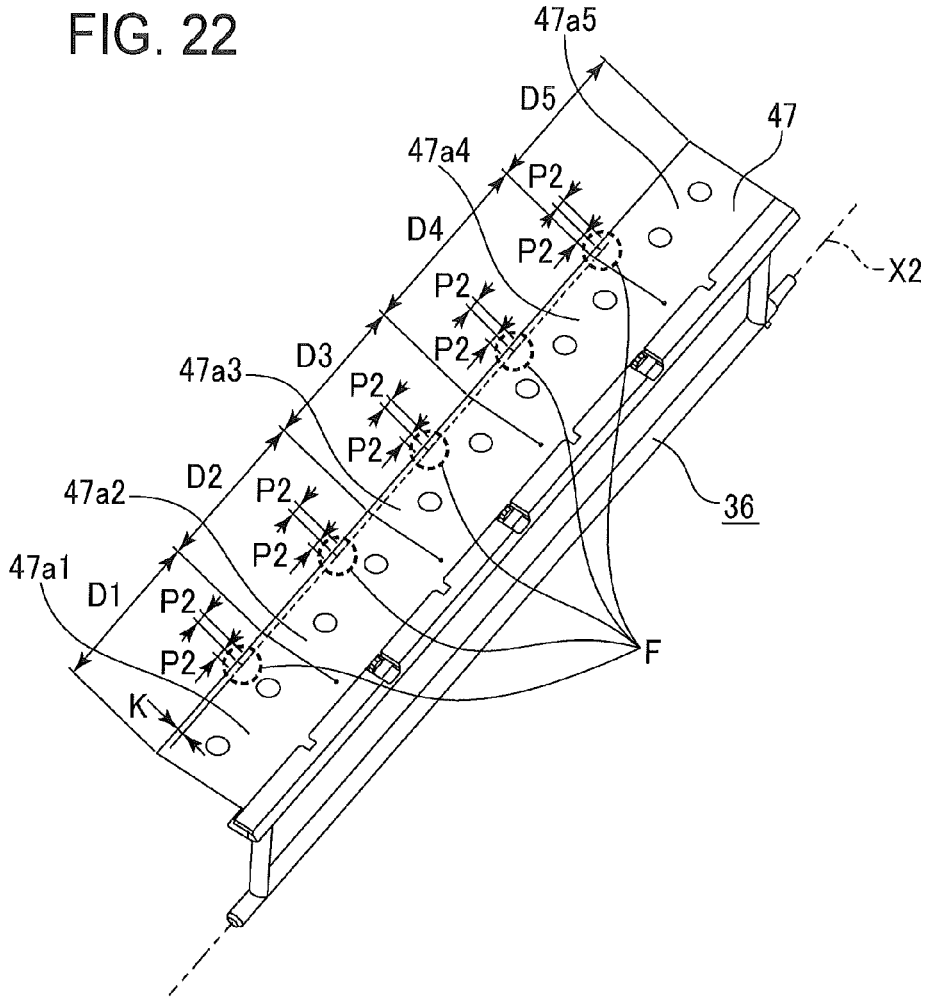
FIGS. 22 and 23 illustrate a second modification to the second embodiment.
Figure 23:
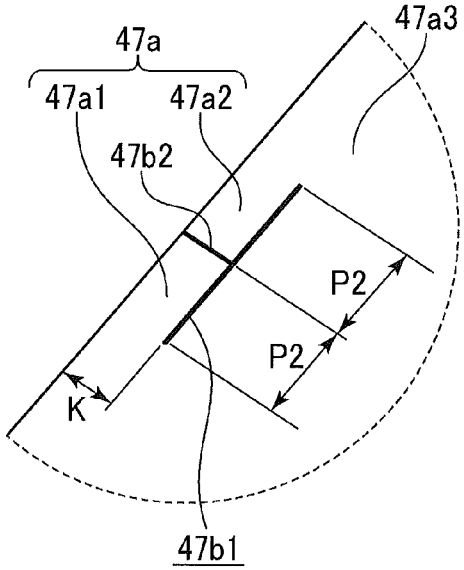

FIGS. 22 and 23 illustrate a second modification to the second embodiment. A main agitating film 47 according to the second modification has substantially the same shape as the main agitating film 45 according to the second embodiment. The main agitating film 47 has T-shaped cuts 47*b*. Each T-shaped cut 47*b* includes a base leg 47*b*1 and an upstanding leg 47*b*2 disposed centrally normally to the base leg 47*b*1. The base leg 47*b*1 extends in a direction substantially parallel to a direction in which the shafts 36*a* extend, and the upstanding leg 47*b*2 extends in a direction substantially perpendicular to a direction in which the shafts 36*a* extend, thereby defining two deformable strips 47*a*1 and 47*a*2. The upstanding leg 47*b*2 has a length k of 2 mm, and extends from a longitudinally middle point of the long side. The base leg 47*b*1 has a length 2×P2, e.g., 2×3 mm.

When the main agitating film 47 rotates, the deformable strips 47*a*1 and 47*a*2 abut the outer arcuate surface of the circumferential rib 33*a*, providing effects similar to those obtained from the main agitating film 45 of the second embodiment.

Figure 24:
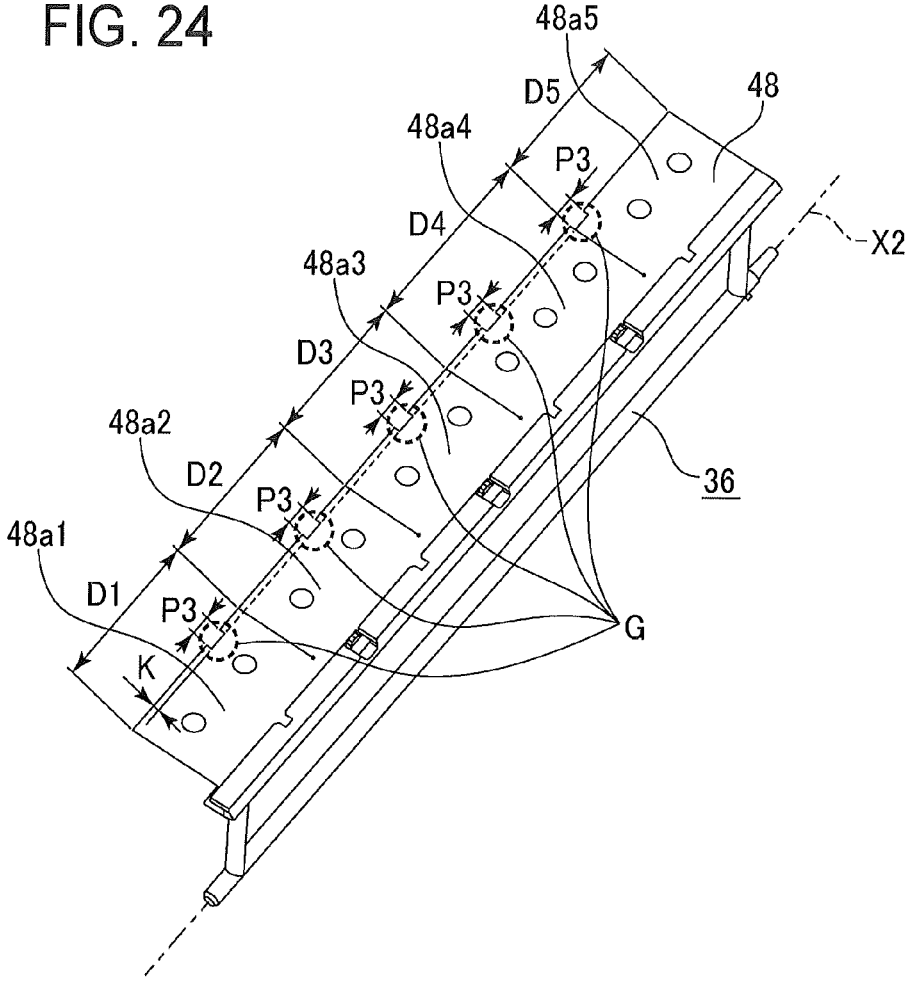
FIGS. 24 and 25 illustrate a third modification to the second embodiment.
Figure 25:
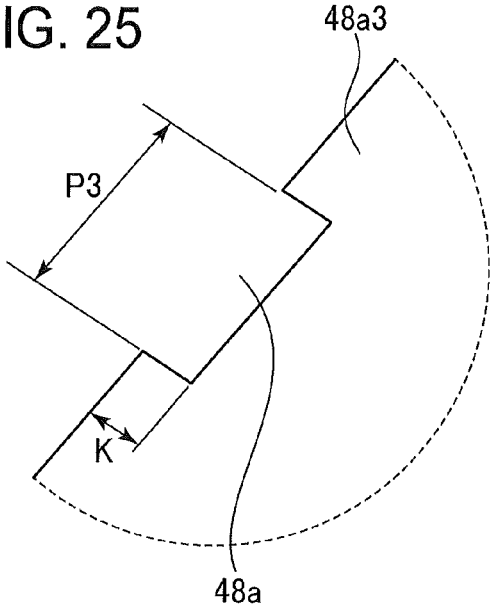

FIGS. 24 and 25 illustrate a third modification to the second embodiment. The third modification differs from the second embodiment in that a main agitating film 48 has a plurality of cutouts 48*a*. The cutout 48*a* has a depth k, e.g., 2 mm and a width P3, e.g., 3 mm.

When the main agitating film 48 rotates, the circumferential ribs 33*a* enter the corresponding cutouts 48*a*, providing effects similar to those of the main agitating film 45 of the second embodiment.

The present invention has been described in terms of a developer material holding apparatus for use in a printer. However, the invention may also be applied to conventional image forming units and image forming apparatus including a facsimile machine, a copying machine, and a multifunction peripheral that is equipped with a developer material holding device and an image forming unit.

What is claimed is:

1. A developer material holding apparatus, comprising:

a first chamber that extends in a first longitudinal direction thereof and holds a developer material therein;

a first rotatable member rotatably supported in the first chamber and rotatable about a first rotational shaft, in contact with an inner wall of the first chamber;

a first opening formed in the first chamber through which the developer material is discharged;

a second chamber adjacent to the first chamber and holding the developer material therein, the second chamber extending substantially in parallel with the first longitudinal direction;

a second rotatable member rotatably supported in the second chamber, the second rotatable member being rotatable, about a second rotational shaft, in contact with an inner wall of the second chamber;

a communication port through which the first chamber communicates with the second chamber; and a shutter that opens and closes the communication port, the shutter including a plurality of ribs aligned in the first longitudinal direction at intervals to define a second opening between adjacent ribs;

wherein the first rotational shaft and the second rotational shaft lie in an imaginary plane, the first opening is under the imaginary plane with respect to a gravity direction and opening downwardly, and the communication port is at a position such that the imaginary plane extends through the communication port, wherein, when the shutter is moved to a closed position, the shutter closes the communication port and, when the shutter is moved to an open position, the plurality of ribs face the communication port so that the first chamber communicates with the second chamber through the second opening, wherein, when the first rotatable member is rotated, the first rotatable member rotates in contact with the plurality of ribs, and when the second rotatable member is rotated, the second rotatable member rotates in contact with the plurality of ribs.

2. The developer material holding apparatus according to claim 1, wherein, when the shutter opens and closes the communication port, the shutter also opens and closes the first opening.

3. The developer material holding apparatus according to claim 1, wherein the shutter closes the communication port and the first opening simultaneously.

4. The developer material holding apparatus according to claim 1, wherein the shutter opens the communication port and the first opening simultaneously.

5. The developer material holding apparatus according to claim 1, wherein the second chamber has a larger volume for holding the developer material than the first chamber.

6. The developer material holding apparatus according to claim 5, wherein the shutter is received in the first chamber.

7. The developer material holding apparatus according to claim 1, wherein, when the shutter is at the opening position, the plurality of ribs face the communication port and the first rotatable member rotates and contacts the plurality of ribs in at least part of one complete rotation thereof, and wherein, when the shutter is at the opening position, the plurality of ribs face the communication port and the second rotatable member rotates and contacts the plurality of ribs in at least part of one complete rotation thereof, the plurality of ribs substantially preventing the first rotatable member and the second rotatable member from interfering with each other.

8. The developer material holding apparatus according to claim 7, wherein the first rotatable member includes deformable strips that are brought into contact with the ribs when the first rotatable member rotates.

9. The developer material holding apparatus according to claim 7, wherein the first rotatable member includes a plurality of first thin resilient strips aligned in a direction substantially parallel to a first rotational shaft of the first rotatable member, and the second rotatable member includes a plurality of second thin resilient strips aligned along a second rotational shaft of the second rotatable member;

wherein the plurality of first thin resilient strips and the plurality of second thin resilient strips are in contact with the plurality of ribs when the first and second rotatable members rotate.

10. The developer material holding apparatus according to claim 1, wherein when the developer material holding apparatus is held such that the first chamber and second chamber lie side by side, the bottoms of the first and second chamber lie in a substantially horizontal plane.

11. The developer material holding apparatus according to claim 7, wherein the first rotatable member includes a first member that radially extends from the first rotational shaft of the first rotatable member and is in contact with the inner wall surface of the first chamber;

wherein the second rotatable member includes:

a second member that radially extends from the second rotational shaft of the second rotatable member toward the inner wall surface of the second chamber; and a third member that extends from the second member so that a portion of the third member fixed to the second member is a leading end and a free end of the third member is a trailing end with respect to the second direction of rotation of the second rotatable member, the free end being in contact with an inner wall surface of the second chamber.

12. An image forming unit that employs the developer material holding apparatus according to claim 1.

13. An image forming apparatus that employs the developer material holding apparatus according to claim 1.

14. The developer material holding apparatus according to claim 1, wherein:

when the developer material holding apparatus is attached to a print engine, the first and second chambers are disposed in a substantially horizontal side-by-side position; and the second chamber has a larger developer holding space than the first chamber.

15. The developer material holding apparatus according to claim 1, wherein each of the plurality of ribs is in the shape of an arc extending in a direction substantially perpendicular to the first longitudinal direction.

16. The developer material holding apparatus according to claim 1, wherein the second rotatable member rotates in a direction such that the second rotatable member moves the developer material in the second chamber toward the communication port, and the first rotatable member rotates in the same direction as the second rotatable member.

17. The developer material holding apparatus according to claim 1, wherein the first chamber is a hollow cylinder that includes a first inner cylindrical wall and the second chamber is a hollow cylinder that includes a second inner cylindrical wall, a distance between the first rotational shaft and the first inner cylindrical wall is shorter than a distance between the second rotational shaft and the second inner cylindrical wall.

18. The developer material holding apparatus according to claim 17, wherein the developer material holding apparatus, when in use, is attached to a print engine, and when the developer material holding apparatus has been attached to the print engine, the first chamber and the second chamber lie side by side so that bottoms of the first and second chamber lie substantially in a horizontal plane.

19. The developer material holding apparatus according to claim 1, wherein the first rotatable member includes a first film member with a plurality of slits formed therein, the plurality of slits being aligned in a direction in which the first rotational shaft extends, wherein, when the first rotational member rotates, a portion of the first film member between adjacent slits moves into contact engagement with at least one of the ribs, wherein the second rotatable member includes a second film member with a plurality of slits formed therein, the plurality of slits being aligned in a direction in which the second rotational shaft extends, and wherein, when the second rotational member rotates, a portion of the second film member between adjacent slits moves into contact engagement with at least one of the ribs.

20. The developer material holding apparatus according to claim 19, wherein the second rotatable member includes a supporting portion at each longitudinal end portion of the second rotational shaft, and a space defined between the second rotational shaft and the second film member.

* * * * *